US009093779B1

(12) United States Patent
Wang et al.

(10) Patent No.: US 9,093,779 B1
(45) Date of Patent: Jul. 28, 2015

(54) WATER-PROOF CONNECTOR

(71) Applicant: Cheng Uei Precision Industry Co., Ltd., New Taipei (TW)

(72) Inventors: Hung Chi Wang, New Taipei (TW); Chin Te Chiu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/179,532

(22) Filed: Feb. 12, 2014

(51) Int. Cl.
*H01R 13/52* (2006.01)
*H01R 24/60* (2011.01)

(52) U.S. Cl.
CPC ..... *H01R 13/5219* (2013.01); *H01R 24/60* (2013.01)

(58) Field of Classification Search
CPC ..... H01R 13/6658; H01R 12/724; H01R 13/506; H01R 13/5202; H01R 13/516; H01R 13/4361; H01R 13/6272; H01R 13/521; H01R 13/426; H01R 13/5219; H01R 12/006; H01R 24/60
See application file for complete search history.

(56) References Cited

U.S. PATENT DOCUMENTS

| | | | | |
|---|---|---|---|---|
| 7,448,908 | B2 * | 11/2008 | Iwahori et al. | 439/587 |
| 7,922,535 | B1 * | 4/2011 | Jiang et al. | 439/607.35 |
| 8,070,516 | B2 * | 12/2011 | Chiang | 439/607.27 |
| 8,128,431 | B2 * | 3/2012 | Kato et al. | 439/587 |
| 8,133,076 | B2 * | 3/2012 | Nakamura | 439/595 |
| 8,523,581 | B2 * | 9/2013 | Martin et al. | 439/83 |
| 2004/0266243 | A1 * | 12/2004 | Murakami | 439/271 |
| 2011/0217859 | A1 * | 9/2011 | Kimura | 439/271 |
| 2012/0108095 | A1 * | 5/2012 | Liu et al. | 439/271 |
| 2013/0137285 | A1 * | 5/2013 | Miura et al. | 439/271 |

* cited by examiner

*Primary Examiner* — Jean F Duverne
(74) *Attorney, Agent, or Firm* — Cheng-Ju Chiang

(57) ABSTRACT

A water-proof connector includes an internal housing, a PCB, a shielding shell, a sealing ring and an external housing. The internal housing has a base portion and a tongue board. A central of the internal housing defines an inserting chamber. A rear of the base portion is concaved forward to form a first receiving cavity, and further concaved forward to form an extending cavity. The PCB includes a connecting portion and an inserting portion. A plurality of terminals are electroplated in the inserting portion. The inserting portion of the PCB is inserted in the inserting chamber and the connecting portion is inserted in the extending cavity. The shielding shell covers around the tongue board of the internal housing. The sealing ring sheathes an outside of the connecting portion of the PCB. The external housing is molded outside the internal housing, the PCB, the shielding shell and the sealing ring.

10 Claims, 6 Drawing Sheets

WATER-PROOF CONNECTOR

BACKGROUND OF THE INVENTION

1. Field of the Invention

The present invention relates to a connector, and more particularly to a water-proof connector.

2. The Related Art

A traditional water-proof connector includes an internal housing, a plurality of terminals, a shielding shell and an external housing. The terminals are integrated in the internal housing. The shielding shell sheathes outside the internal housing. The external housing is molded outside the internal housing and the external shell.

However, the sealability of the traditional water-proof connector is poor, so water is easily infiltrate into the interior of the traditional water-proof connector by the high pressure of the water. So inventor need to provide a high grade of water-proof connector to resolve the defect of the traditional water-proof connector.

SUMMARY OF THE INVENTION

Accordingly, an object of the present invention is to provide a water-proof connector. The water-proof connector includes an internal housing, a PCB (Printed Circuit Board), a shielding shell, a sealing ring and an external housing. The internal housing has a base portion. A front of the base portion extends frontward to form a tongue board with a smaller dimension than the base portion. A central of the internal housing defines an inserting chamber penetrating through the front and rear faces of the internal housing in longitudinal direction. A rear face of the base portion surrounding the inserting chamber is concaved forward to form a first receiving cavity, and a bottom face of the first receiving cavity is further concaved forward to form an extending cavity. The PCB includes a connecting portion and an inserting portion. A plurality of terminals are electroplated in the inserting portion. The inserting portion of the PCB is inserted in the inserting chamber of the internal housing. A front end of the connecting portion of the PCB is inserted in the extending cavity of the base portion of the internal housing. The shielding shell covers around the tongue board of the internal housing. The sealing ring sheathes an outside of the connecting portion of the PCB and the front end of the sealing ring is inserted in the first receiving cavity of the internal housing. The external housing is molded outside the internal housing, the PCB, the shielding shell and the sealing ring.

As described above, the embodiment of the invention of the water-proof connector by virtue of the shielding shell sheathes an outside of the front end of the internal housing, the PCB is inserted in the internal housing, the sealing ring sheathes an outside of the PCB and sealed in the rear of the internal housing to reach a high grade of water-proof ingress protection.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
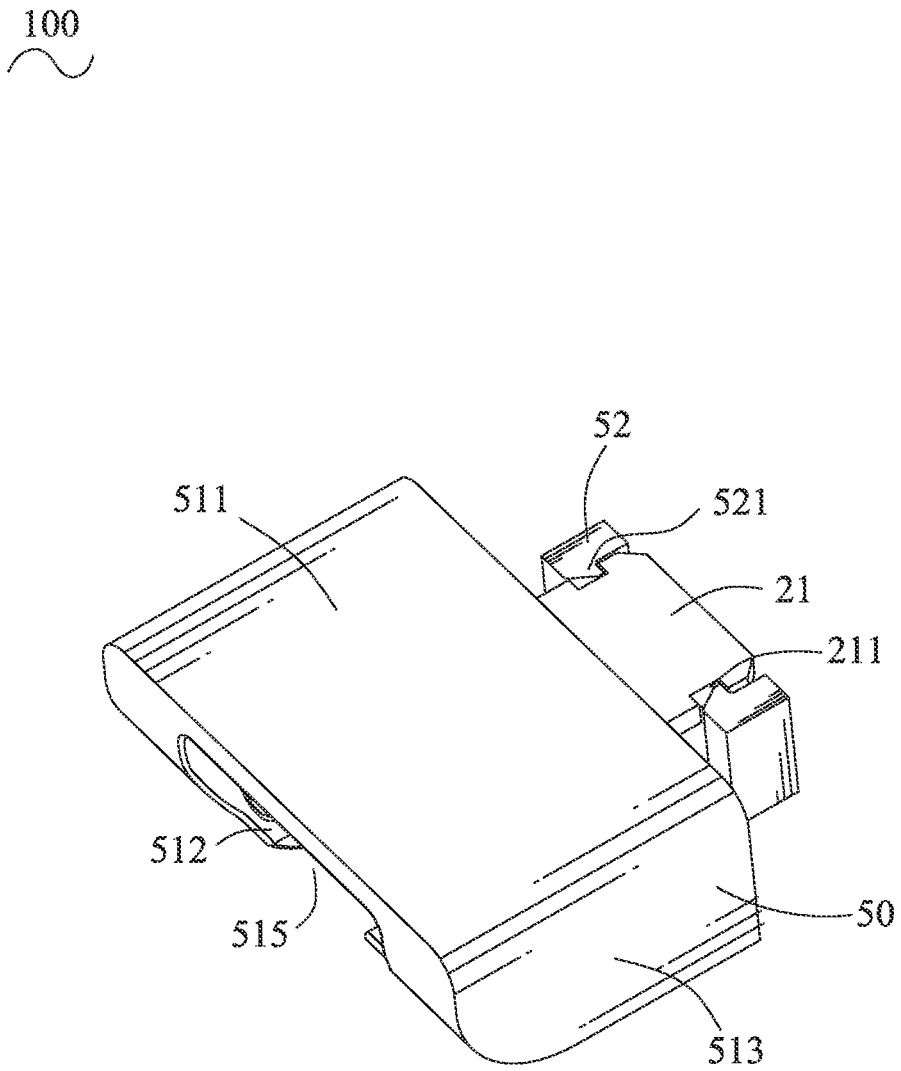
FIG. 1 is an assembled, perspective view of a water-proof connector in accordance with an embodiment of the present invention.
Figure 2:
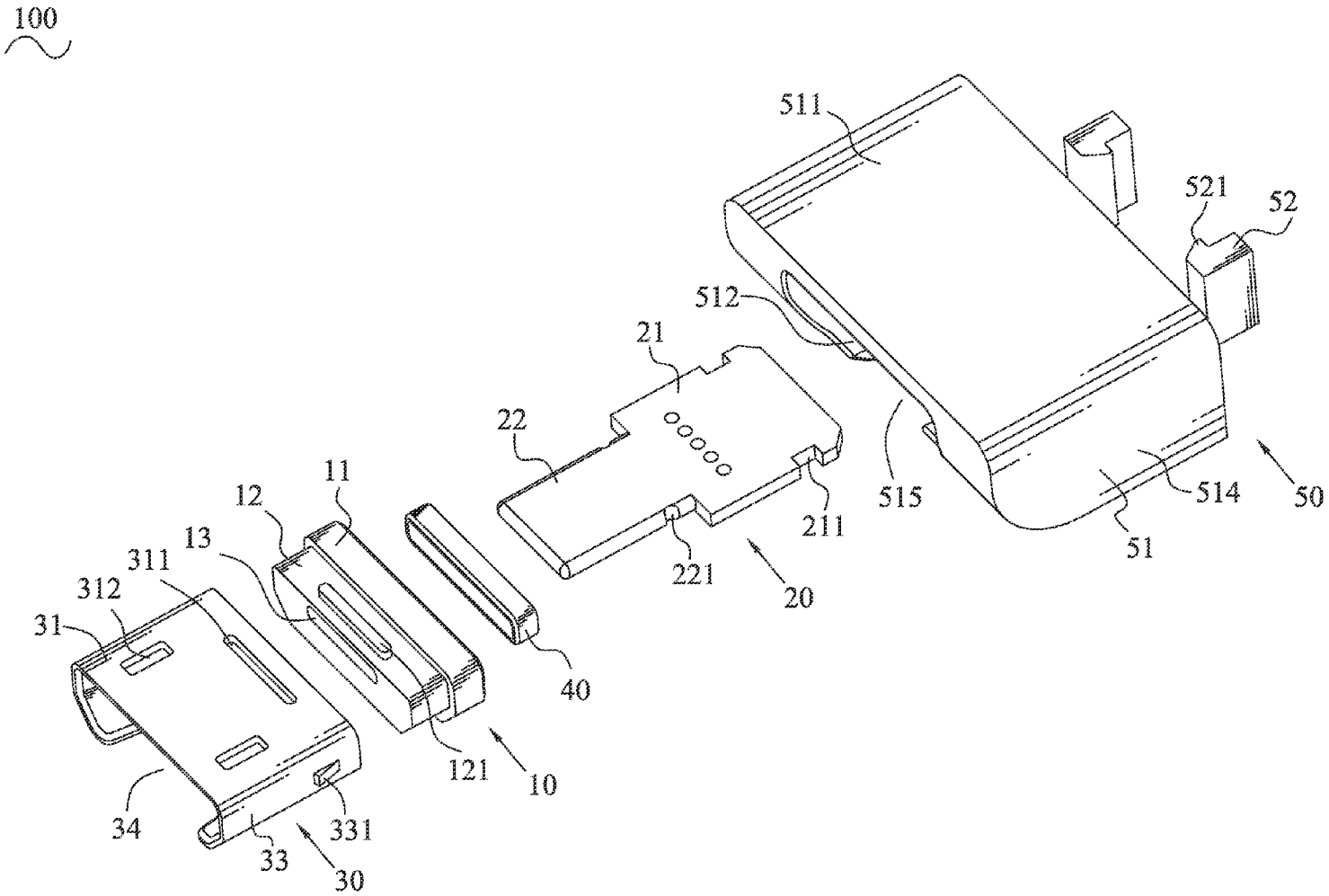
FIG. 2 is an exploded, perspective view of the water-proof connector shown in FIG. 1.
Figure 3:
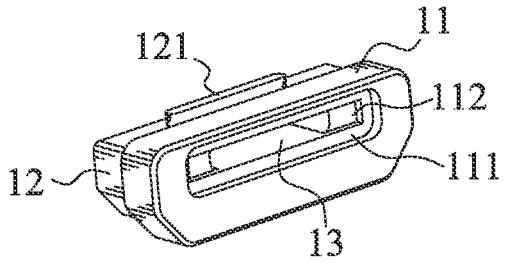
FIG. 3 is a perspective view of the internal housing of the water-proof connector shown in FIG. 1.
Figure 4:
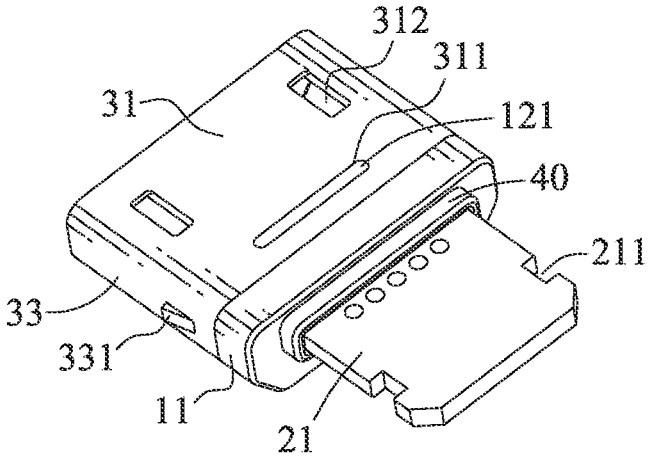
FIG. 4 is a perspective view of the water-proof connector without external housing shown in FIG. 1.
Figure 5:
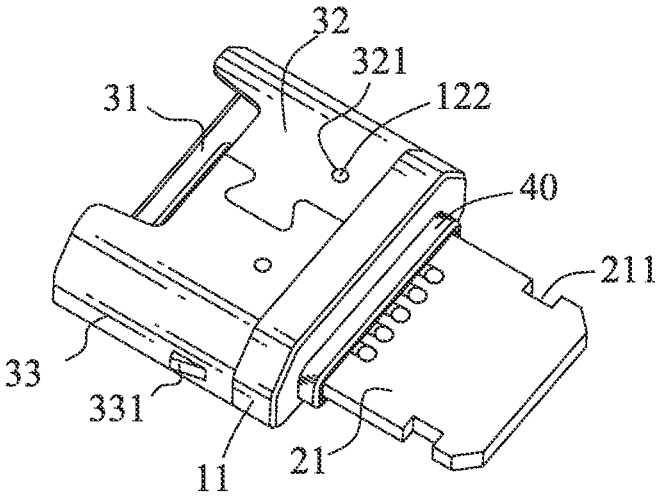
FIG. 5 is another perspective view of the water-proof connector shown in FIG. 4.
Figure 6:
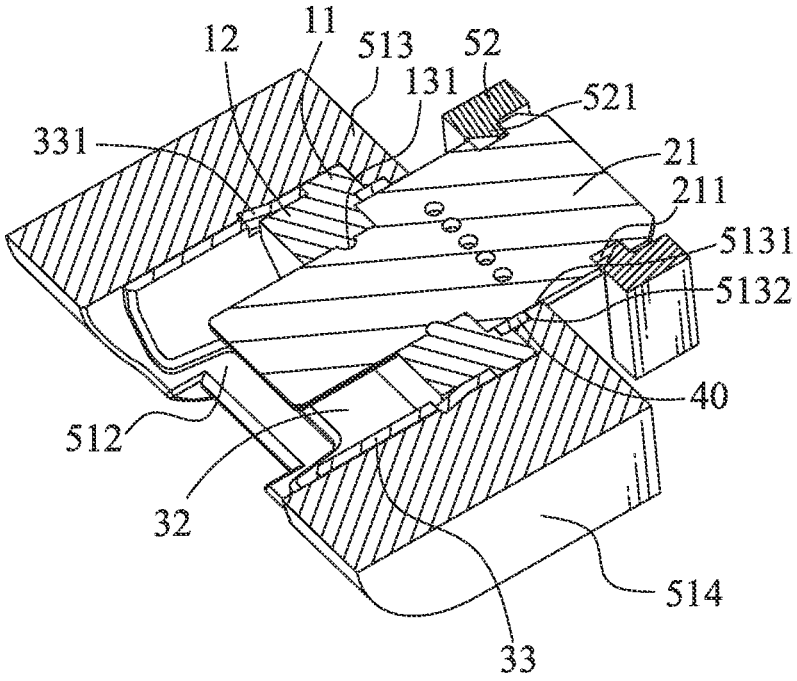
FIG. 6 is a cross-sectional view of the water-proof connector shown in FIG. 1.

Referring to FIG. 1 and FIG. 2, an embodiment of the present invention is shown as a water-proof connector 100 includes an internal housing 10, a PCB 20, a shielding shell 30, a sealing ring 40 and an external housing 50.

Referring to FIGS. 2 to 6, the internal housing 10 has a base portion 11. A front of the base portion 11 extends frontward to form a tongue board 12 with a smaller dimension than the base portion 11. A central of the internal housing 10 defines an inserting chamber 13 penetrating through the front and rear faces of the internal housing 10 in longitudinal direction. Two opposite sidewalls of the inserting chamber 13 protrude face-to-face inward to form a pair of convex 131. A central of a top face of the tongue board 12 protrudes upward to form an elongated blocking lump 121. Two opposite sides of a bottom face of the tongue board 12 protrude downward to form a pair of blocking columns 122. A rear face of the base portion 11 surrounding the inserting chamber 13 is concaved forward to form a first receiving cavity 111, and a bottom face of the first receiving cavity 111 is further concaved forward to form an extending cavity 112.

The PCB 20 has a connecting portion 21 and an inserting portion 22 extending frontward from the connecting portion 21. In the embodiment of the present of the water-proof connector 100, a plurality of terminals (not shown) are electroplated in the bottom face of the inserting portion 22. Two opposite sides of the connecting portion 21 of the PCB 20 are concaved inward to form a pair of positioning slots 211. Two opposite sides of the inserting portion 22 of the PCB 20 are concaved inward to form a pair of slots 221 corresponding to the convex 131 of the internal housing 10. The inserting portion 22 of the PCB 20 is inserted in the inserting chamber 13 of the internal housing 10, and the front end of the connecting portion 21 is received in the extending cavity 112 of the base portion 11 of the internal housing 10.

The shielding shell 30 has a top plate 31, a bottom plate 32 and two side plates 33. The top plate 31, bottom plate 32 and two side plates 33 together form a receiving slot 34. The shielding shell 30 covers around the tongue board 12 of the internal housing 10, and the tongue board 12 is held in the receiving slot 34 of the shielding shell 30. The top plate 31 of the shielding shell 30 is defined a blocking slot 311 corresponding to the blocking lump 121 of the internal housing 10. Two opposite sides of a front end of the top plate 31 of the shielding shell 30 are defined a pair of locking slots 312 corresponding to the locking grabs (not shown) of the butting connector (not shown). The bottom plate 32 of the shielding shell 30 is defined a pair of blocking holes 321 corresponding to the blocking columns 122 of the internal housing 10. Two side plates 33 of the shielding shell 30 protrude outward to form a pair of buckling slices 331.

The sealing ring 40 sheathes an outside of the PCB 20.

The external housing 50 has an external shell 51 and a pair of positioning lumps 52. The external shell 51 has a top wall 511, a bottom wall 512, a rear wall 513 and two side walls 514. The top wall 511, bottom wall 512, rear wall 513 and two side walls 514 together form an accepting cavity 515. The rear wall 513 of the external shell 51 is defined a through hole 5131 penetrating through the rear wall 513 corresponding to the extending cavity 112 of the internal housing 10. A front face of the rear wall 513 of the external shell 51 surrounding the through hole 5131 is concaved rearward to form a second receiving cavity 5132. Two positioning lumps 52 of the external housing 50 protrude face-to-face to form a pair of wedge-shaped lumps 521, the rear of the wedge-shaped lump 521 is thicker than the front thereof.

Referring to FIGS. 1 to 6, in assembly, the PCB 20 and the shielding shell 30 are placed in a mould, and inserting portion 22 of the PCB 20 is inserted in the receiving slot 34 of the shielding shell 30. The tongue board 12 of the internal housing 10 is molded in the gap between the inserting portion 22 of the PCB 20 and the shielding shell 30 and the base portion 11 of the internal housing 10 is molded surround the connecting portion 21 of the PCB 20 in the rear of the shielding shell 30, and the overall dimension of the base portion 11 of the internal housing 10 is the same as the shielding shell 30. The inserting portion 21 of the PCB 20 is inserted in the inserting chamber 13 of the internal housing 10 and the two convex 131 of the inserting chamber 13 are fastened in the slots 221 of the inserting portion 22. A front end of the connecting portion 21 of the PCB 20 is inserted in the extending cavity 112 of the base portion 11 of the internal housing 10. The blocking lump 121 of the tongue board 12 of the internal housing 10 is buckled in the blocking slot 311 of the top plate 31 of the shielding shell 30. The two blocking columns 122 of the tongue board 12 of the internal housing 10 are buckled in the blocking holes 321 of the bottom plate 32 of the shielding shell 30.

Fill a little plastic in the first receiving cavity 111 of the base portion 11 of the internal housing 10. Then, the sealing ring 40 sheathes an outside of the connecting portion 21 of the PCB 20 and move the sealing ring 40 forward till the front end of the sealing ring 40 is inserted in the first receiving cavity 111 of the internal housing 10.

The external housing 50 is molded outside the internal housing 10, the PCB 20, the shielding shell 30 and the sealing ring 40. The internal housing 10 and the shielding shell 30 are received in the accepting cavity 515 of the external shell 51 of the external housing 50. The buckling slices 331 of two side plates 33 of the shielding shell 30 resist against the sidewalls of the accepting cavity 515 to prevent the external shell 51 away from the shielding shell 30. The rear end of the sealing ring 40 is received in the second cavity 5132. The connecting portion 21 of the PCB 20 passes through the through hole 5131 of the external shell 51 and projects beyond the rear face of the rear wall 513 of the external shell 51. Two positioning lumps 52 are positioned at two opposite sides of the connecting portion 21 of the PCB 20, and the wedge-shaped lumps 521 of the positioning lumps 52 are buckled in the positioning slots 211 to prevent the PCB 20 pull out of the butting connector.

As described above, the embodiment of the invention of the water-proof connector 100 by virtue of the shielding shell 30 sheathes an outside of the front end of the internal housing 10, the PCB 20 is inserted in the internal housing 10, the sealing ring 40 sheathes an outside of the PCB 20 and sealed in the rear of the internal housing 10 to reach a high grade of water-proof ingress protection.

What is claimed is:

1. A water-proof connector, comprising:

an internal housing having a base portion, a front of the base portion extending frontward to form a tongue board with a smaller dimension than the base portion, a central of the internal housing defining an inserting chamber penetrating through the front and rear faces of the internal housing in longitudinal direction, a rear face of the base portion surrounding the inserting chamber being concaved forward to form a first receiving cavity, and a bottom face of the first receiving cavity being further concaved forward to form an extending cavity;

a printed circuit board (PCB) including a connecting portion and an inserting portion, a plurality of terminals being electroplated in the inserting portion, the inserting portion of the PCB is inserted in the inserting chamber of the internal housing, a front end of the connecting portion of the PCB is inserted in the extending cavity of the base portion of the internal housing;

an shielding shell covers around the tongue board of the internal housing;

a sealing ring sheathes an outside of the connecting portion of the PCB and the front end of the sealing ring is inserted in the first receiving cavity of the internal housing; and an external housing is molded outside the internal housing, the PCB, the shielding shell and the sealing ring.

2. The water-proof connector as claimed in claim 1, wherein the shielding shell having a top plate, a bottom plate and two side plates, the top plate, bottom plate and two side plates together form a receiving slot, the tongue board is held in the receiving slot of the shielding shell.

3. The water-proof connector as claimed in claim 2, wherein a central of a top face of the tongue board protruding upward to form a blocking lump, the top plate of the shielding shell being defined a blocking slot corresponding to the blocking lump of the internal housing, the blocking lump of the tongue board of the internal housing is buckled in the blocking slot of the top plate of the shielding shell.

4. The water-proof connector as claimed in claim 2, wherein two opposite sides of a bottom face of the tongue board protruding downward to form a pair of blocking columns, the bottom plate of the shielding shell being defined a pair of blocking holes corresponding to the blocking columns of the internal housing, the two blocking columns of the tongue board of the internal housing is buckled in the blocking holes of the bottom plate of the shielding shell.

5. The water-proof connector as claimed in claim 2, wherein two opposite sides of a front end of the top plate of the shielding shell being defined a pair of locking slots.

6. The water-proof connector as claimed in claim 1, wherein two opposite sidewalls of the inserting chamber protruding face-to-face inward to form a pair of convex, two opposite sides of the inserting portion of the PCB being concaved inward to form a pair of slots corresponding to the convex of the internal housing, the two convex of the inserting chamber are fastened in the slots of the inserting portion.

7. The water-proof connector as claimed in claim 1, wherein the external housing including an external shell and a pair of positioning lumps, the external shell having a top wall, a bottom wall, a rear wall and two side walls, the top wall, bottom wall, rear wall and two side walls together form an accepting cavity, the internal housing and the shielding shell are received in the accepting cavity of the external shell of the external housing, two positioning lumps are positioned at two opposite sides of the connecting portion of the PCB.

8. The water-proof connector as claimed in claim 7, wherein two side plates of the shielding shell protruding outward to form a pair of buckling slices, the buckling slices of two side plates of the shielding shell resist against the sidewalls of the accepting cavity.

9. The water-proof connector as claimed in claim 7, wherein the rear wall of the external shell being defined a through hole penetrating through the rear wall corresponding to the extending cavity of the internal housing, a front face of the rear wall of the external shell surrounding the through hole being concaved rearward to form a second receiving cavity, the rear end of the sealing ring is received in the second cavity, the connecting portion of the PCB passes through the through hole of the external shell and projects beyond the rear face of the rear wall of the external shell.

10. The water-proof connector as claimed in claim 7, wherein two positioning lumps of the external housing protruding face-to-face to form a pair of wedge-shaped lumps, and the rear of the wedge-shaped lump is thicker than the front thereof, the wedge-shaped lumps of the positioning lumps are buckled in the positioning slots.

* * * * *